United States Patent [19]

Tommaney

[11] Patent Number: 4,529,443

[45] Date of Patent: Jul. 16, 1985

[54] SYSTEM AND METHOD FOR PRODUCING STEEL IN A TOP-BLOWN VESSEL

[75] Inventor: Joseph W. Tommaney, Buffalo Township, Butler County, Pa.

[73] Assignee: Allegheny Ludlum Steel Corporation, Pittsburgh, Pa.

[21] Appl. No.: 604,099

[22] Filed: Apr. 26, 1984

[51] Int. Cl.[3] ..... C21C 7/00; C21D 11/00

[52] U.S. Cl. ..... 75/59.12; 75/59.29; 75/59.3; 75/59.31; 266/78

[58] Field of Search ..... 75/59, 60; 266/78

[56] References Cited

U.S. PATENT DOCUMENTS 3,998,626 12/1976 Baum ..... 75/60

4,260,415 4/1981 Simmons ..... 75/60

*Primary Examiner*—Peter D. Rosenberg

*Attorney, Agent, or Firm*—Patrick J. Viccaro

[57] ABSTRACT

A system and method is provided for refining molten metal in a top-blown vessel, particularly, by removal of the carbon content. The system includes various means for selecting, regulating the composition and controlling the rate of flow of the top-blown gases. The system further includes various means for introducing an inert gas from beneath the molten bath surface during top blowing and regulating the composition and controlling the rate of flow of the inert gas as a function of the top-blown gas composition and flow rate.

A method for introducing the gases is also provided.

9 Claims, 2 Drawing Figures

SYSTEM AND METHOD FOR PRODUCING STEEL IN A TOP-BLOWN VESSEL

BACKGROUND OF THE INVENTION

This invention relates to a system and a method for top blowing processes for refining molten metal in a vessel. Particularly, the invention relates to a system and method for top blowing processes for improving the removal of carbon, such as in a basic oxygen process.

It is known to produce ferrous metals in molten metal vessels wherein top blowing with oxygen through a lance positioned above the bath is used. For this purpose, the vessel, such as a basic oxygen furnace, is typically charged with 60 to 80% hot metal, for example, from a blast furnace and 20 to 40% of a cold charge which may be high-carbon chromium alloy and/or stainless steel scrap. Top oxygen blowing is performed until the final bath carbon level has been reduced to approximately 0.035 to 0.05%; at which time the bath temperature is typically 3400° to 3600° F. (1871° to 1982° C.). At such carbon content which may be currently achieved by use of a top-blown basic oxygen converter, the bath temperatures are sufficiently high that excessive refractory wear occurs and, thus, charging of scrap for cooling of the bath is necessary. Presently, many product specifications require carbon levels less than 0.03%. The standard basic oxygen furnace practice and systems cannot attain such low carbon levels.

It is also known in top-blown oxygen steelmaking processes of this type, to blend an inert gas, such as argon, with the oxygen introduced by top blowing near the end of the blowing cycle. Although the argon serves to improve the efficiency of the carbon removal, nevertheless, stainless steels having carbon contents less than about 0.03% may not be commercially produced on a consistent basis.

It has been proposed to adapt a basic oxygen converter vessel for introduction of an inert gas into the bath from beneath the surface thereof by the use of tuyeres or porous plugs arranged on or near the bottom of the vessel. One practice is disclosed in concurrently filed, copending application Ser. No. 604,098, filed Apr. 26, 1984, comprising top blowing from a lance oxygen and/or a mixture of oxygen and inert gas onto or beneath the surface while introducing a low flow rate inert gas to the bath from beneath the surface during the top blowing. The overall ratio of oxygen-to-inert gas is decreased progressively during top blowing. The relative proportion of the top-blown gases and bottom-blown inert gases remain substantially the same throughout the process.

Another practice would involve increasing the rate of inert gas introduced from beneath the surface of the bath and decreasing the oxygen introduced by top blowing of oxygen only as the refining operation progresses in the manufacture of stainless steels, for example. Such a method is disclosed in concurrently filed, copending application Ser. No. 604,097, filed Apr. 26, 1984. Specifically, an inert gas is employed in combination with oxygen to provide a relatively high ratio of oxygen-to-inert gas being relatively high during initial blowing and decreasing the ratio as the blowing progresses. Initially the rate of oxygen introduced is significantly higher than the rate of inert gas introduced, however, at the end of the blow the rate of inert gas introduced is significantly higher than the rate of oxygen. The tuyeres positioned in the vessel for inert gas introduction must be capable of relatively high gas flow rates.

The manufacture of other types of steel in top-blown vessels, such as an oxygen converter, may require relatively low flow rates of inert gas through the tuyeres, such as in the manufacture of low-alloy steel. Consequently, if the tuyeres or porous plugs are designed for relatively low flow rates, the tuyeres will not be able to provide the required higher inert gas flow rates for other steel production. Such tuyeres designed for the specific flow rates required in refining one type of steel will not be suitable for use in refining other types of steel wherein significantly different gas flow rates are required. In a practice of this type, therefore, one will not be able to, for example, alternate in the production of silicon steel and stainless steel in the same vessel. Consequently, a basic oxygen converter vessel will require expensive, time consuming alteration to be converted, for example, from the manufacture of stainless steel to the manufacture of silicon steel. This adds considerably to the overall melt shop production costs.

It is, accordingly, an object of the invention to provide a system and method for producing steel in a top-blown molten metal vessel having improved flexibility in regulating and controlling the top-blown gas and the gases introduced beneath the bath surface.

Another object is to provide a system which permits alternate production of various grades of steel in the same vessel without expensive time-consuming alteration.

An object of the invention is to provide a system useful in methods of producing steel wherein the refining gases can be more efficiently used.

Another object is to provide a system which improves the production yield of steel from top-blown vessels.

SUMMARY OF THE INVENTION

In accordance with the present invention, a system is provided for producing steel in a top-blown vessel having a hot metal charge by removing carbon until the desired carbon content of the bath is achieved. The system includes means for selecting gases to be top blown, means for top blowing the gas from a lance onto or beneath the surface of the bath, and means for selecting inert gas to be introduced to the bath from beneath the surface during the top blowing and means for introducing the inert gas from beneath the surface. The system further includes separate means for regulating the composition of the top blown gas and the composition of the inert gas introduced beneath the bath surface. Also included are separate means for controlling the rate of flow in the top-blown gas and for controlling the rate of flow of the inert gas introduced beneath the bath surface as a function of the top-blown gas composition and rate of flow.

A method for introducing the gases in a top-blown molten metal vessel is also provided.

DETAILED DESCRIPTION OF THE PREFERRED EMBODIMENTS

The system and method of the present invention relates to producing steel in a top-blown molten metal vessel having a hot metal charge forming a bath. The charge could be prealloyed and comprising substantially all molten metal, such as could be supplied from an electric furnace, having relatively low carbon. The charge may include cold charge materials, such as scrap, chromium and other materials, and have higher carbon levels. Typically, a top-blown molten metal vessel, such as a basic oxygen converter, would have a high carbon hot metal charge and a cold material charge to form a bath.

In the practice of the invention, a top-blown molten metal vessel, such as a basic oxygen converter, may be used having a conventional lance adapted for introducing a refining gas onto or beneath the surface of the molten bath within the vessel and additionally, having means such as tuyeres and/or porous plugs, positioned on or near the bottom of the vessel for introduction of inert gas beneath the surface of the bath. The lance may be suspended above the bath or be a type capable of being submerged within the bath, both of which practices are conventional and well known in the art.

In the manufacture of various steels, it is necessary that the ratio of oxygen-to-inert gas be capable of being changed before and/or during the top blowing cycle. The system of the present invention may be used in the manufacture of stainless steel, for example, in vessels that are suitable for the manufacture of a variety of steels. What is necessary is that the top-blown gases and the gases introduced beneath the bath surface be separately regulated and controlled as a function of the flow rate and composition of the other. It is understood that while various gases and gas mixtures are possible with the system, the usefulness of the compositions depends upon many variables, including the molten metal bath composition and the desired kinetics of the reactions.

The inert gas, as used herein, is substantially nonreactive with the molten metal and could be argon, nitrogen, xenon, neon, and the like, and mixtures thereof. It is understood that nitrogen, although identified as an inert gas herein, could react with any nitride-forming constituents remaining in the bath. Endothermic gases, such as carbon dioxide, are also suitable and as used herein, "inert gas" includes endothermic gas.

It is also intended that dry air may be used to supply some or all of an oxygen-inert gas mixture for the top-blown refining gas. As used herein, "dry air" means air satisfying the conditions disclosed in U.S. Pat. No. 4,260,415, issued Apr. 7, 1981, to the Assignee of the present application.

Figure 1:
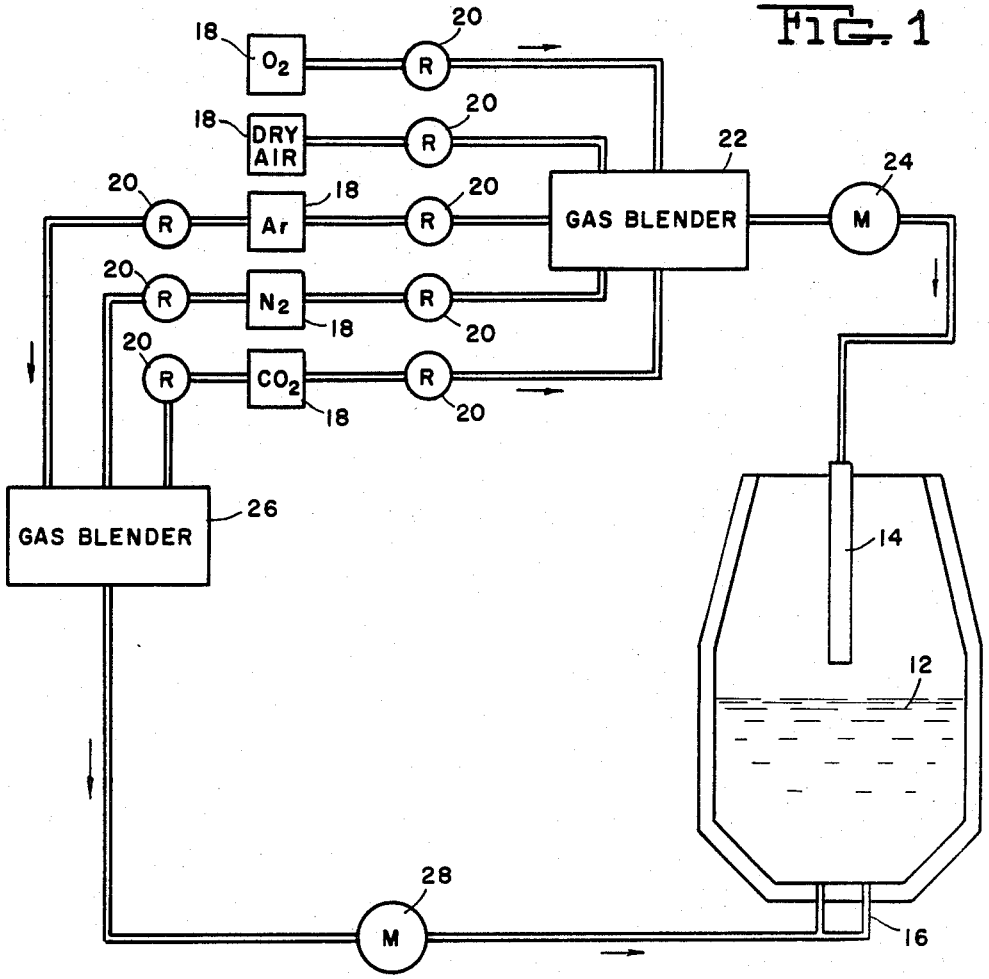
FIG. 1 is a schematic diagram of the system of the present invention.

FIG. 1 shows a molten metal vessel 10, such as a basic oxygen converter, containing a molten metal bath 12. The molten metal bath 12 composition may vary and may include a high-carbon hot metal charge and a cold material charge at the beginning of the top blowing cycle and should comprise a substantially homogeneous molten metal composition at the end of the blowing cycle. The system may include a lance 14 suspended above the bath. The lance may also be a type capable of being submerged within the bath. The lance provides the means for top blowing the gas onto or beneath the surface of the bath. FIG. 1 also shows the vessel 10 having a means for introducing an inert gas to the bath from beneath the surface of the bath during the top blowing, such as tuyeres or porous plugs 16.

The system also includes a means for selecting the gases to be top blown. Typically, the gases are oxygen, air and inert gases and mixtures thereof. A suitable means for selecting the gases would include the necessary storage tanks 18 and regulators 20 and piping necessary to provide the gases to the molten metal vessel.

The means for regulating the composition of the top-blown gas is interposed between the source of the gases and the vessel. The means for regulating should also include suitable valving and piping and a mixing chamber or gas blender 22 in order to provide the desired composition of the top-blown gas. The composition of the top-blown gases may be all oxygen, all inert gas, all dry air, and mixtures thereof.

Also, a means for controlling the rate of flow of the top-blown gas to the molten metal vessel 10 is necessary and is interposed between the regulating means and the vessel. Such a means may include a meter 24 and the like necessary for controlling and measuring the flow rate. As shown, the meter is a total flow meter. It is desirable that the flow rate be controllable from ranges as low as 100 to 7000 NCFM (normal cubic feet per minute). For an 80-ton vessel, such as a basic oxygen converter, the flow rate on a tonnage basis converts to 1.25 to 87.5 NCFM/ton, or approximately 1 to 100 NCFM/ton.

The system includes a means for selecting the inert gas to be introduced from beneath the bath surface. A suitable means would include regulators 20 and piping and the like from tanks 18 to provide the gases. The means for regulating the composition of the inert gas introduced beneath the bath surface through tuyere or porous plugs 16 is similar to that for the top-blown gases and includes a mixing chamber or gas blender 26. A means for controlling the flow rate of the inert gas introduced beneath the bath surface including meter 28 is also provided. As shown, meter 28 is a total flow meter of the bottom gas and gas mixture. Such selecting, regulating and controlling means could be similar to that for the top blown gas; however, the means for controlling the rate of flow of inert gas introduced beneath the bath surface should be a function of the top-blown gas composition and rate of flow. For that purpose, an electrical feedback system could relate the bottom inert gas flow rates to the top-blown gas flow rate in order that the desired balance is achieved. For example, as described in the two copending applications, it may be desirable to maintain a low substantially constant inert gas flow rate introduced beneath the bath surface although the composition of the top-blown gas may vary. Also, the top-blown gas may be maintained as substantially all oxygen or all inert gas, while the inert gas introduced beneath the bath surface may be progressively increased. More specifically, for about 80-ton heats, the inert gas flow introduced beneath the surface may be within the range of approximately 50 to 7500 NCFM, or on a tonnage basis, these rates convert to 0.625 to 93.75 NCFM/ton or approximately 0.5 to 100 NCFM/ton.

Figure 2:
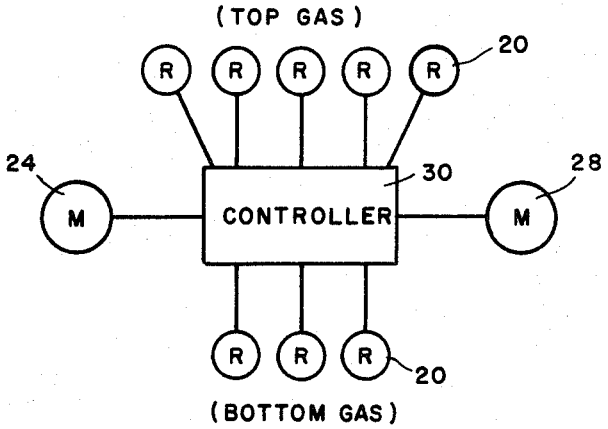
FIG. 2 is an electrical schematic diagram of the system of the present invention.

FIG. 2 is an electrical schematic diagram of the present invention including a master controller 30 which may include a central processing unit. Controller 30 is connected to each regulator 20 for each gas, and to the meters, such as total flow meters 24 and 28 for the top and bottom gases, respectively. Each gas may also be controlled on its own single loop controller or microprocessor. The controller 30 receives the input from the regulators and meters, and based on the information, controls the regulators 20 for each gas as a function of the gas compositions and the oxygen-to-inert gas ratios. Furthermore, such a system has the capability to update the compositions, ratios and switch points at any predetermined time intervals.

In the operation of the present invention, the method for introducing the gases in the top-blown molten metal vessel would include selecting the gases to be top blown, top blowing the gas from a lance onto or beneath the surface of the bath, and selecting inert gas into the bath from beneath the surface of the bath during top blowing and introducing inert gas. The method would include regulating the composition of the top-blown gas and regulating the composition of the inert gas introduced beneath the bath surface. Also, the steps would include controlling the rate of flow of the top-blown gas and controlling the rate of flow of the inert gas introduced beneath the bath surface as a function of the top-blown gas composition and rate of flow and thereafter stopping the top blowing when the desired carbon content of the bath is achieved. The regulation of the top-blown gas composition may be done continuously during the top blowing. The regulation of the top-blown gas composition may be accomplished before or during the top blowing.

The method and system of the present invention provides the capability and flexibility to refine molten metal, particularly by removing carbon, through the selective use and control of refining gases being introduced into the top and bottom portions of a molten metal vessel. The method and system are also intended to be applicable to refining molten metal of all types and to the removal of nitrogen or any other undesired constituent as well as carbon.

Although preferred and alternative embodiments have been described, it will be apparent to those skilled in the art that changes can be made therein without departing from the scope of the invention.

What is claimed is:

1. A system for introducing gas in a top-blown molten metal vessel having a hot metal charge bath to remove carbon until the desired carbon content of the bath is achieved, the system comprising:

means for selecting refining gases to be top blown;

means for top blowing gas from a lance onto or beneath the surface of the bath;

means for selecting an inert gas to be introduced to the bath from beneath the surface of the bath during said top blowing;

means for introducing the inert gas beneath the surface of the bath during said top blowing;

means for regulating the composition of the top-blown gas;

means for regulating the composition of the inert gas introduced beneath the bath surface;

means for controlling the rate of flow of the top-blown gas; and means for controlling the rate of flow of inert gas introduced beneath the bath surface as a function of the top-blown gas composition and rate of flow.

2. The system of claim 1 wherein the means for regulating the top-blown gas composition includes means for regulating before and during the top blowing.

3. A system of claim 1, wherein the means for selecting the top-blown refining gas includes selection of one or more gases from a group consisting of oxygen, dry air, and inert gas.

4. A system of claim 1, wherein the means for selecting an inert gas to be introduced to the bath from beneath the surface includes selection of one or more inert gases from the group consisting of argon, nitrogen, xenon, neon and carbon dioxide.

5. A method for introducing gases in a top-blown molten metal vessel having a high carbon hot metal charge and a cold material charge, the method comprising:

selecting the gases to be top blown;

top blowing gas from a lance onto or beneath the surface of the bath;

selecting an inert gas to be introduced to the bath from beneath the surface of the bath during top blowing;

introducing the inert gas to the bath from beneath the surface of the bath during said top blowing;

regulating the composition of the top-blown gas;

regulating the composition of the inert gas introduced beneath the bath surface;

controlling the rate of flow of the top-blown gas;

controlling the rate of flow of the inert gas introduced beneath the bath surface as a function of the top-blown gas composition and rate of flow; and stopping the top blowing when the desired carbon content of the bath is achieved.

6. The method of claim 5, includes regulating the top-blown gas composition continuously during the top blowing.

7. The method of claim 5, wherein regulating the top-blown gas composition is accomplished before the top blowing commences.

8. A method of claim 5 wherein selecting the gases to be top blown includes selecting one or more gases from a group consisting of oxygen, dry air and inert gases.

9. A method of claim 5, wherein selecting an inert gas to be introduced beneath the bath surface includes selecting one or more inert gases from a group consisting of argon, nitrogen, xenon, neon and carbon dioxide.

* * * * *